US008469338B2

(12) United States Patent
Gann et al.

(10) Patent No.: US 8,469,338 B2
(45) Date of Patent: Jun. 25, 2013

(54) LIFTING APPARATUS

(75) Inventors: Casey R. Gann, Camden Point, MO (US); Peter K. Gillespie, Raytown, MO (US)

(73) Assignee: Shinn Fu Corporation, Taipei (TW)

( * ) Notice: Subject to any disclaimer, the term of this patent is extended or adjusted under 35 U.S.C. 154(b) by 421 days.

(21) Appl. No.: 12/763,749

(22) Filed: Apr. 20, 2010

(65) Prior Publication Data

US 2011/0253955 A1 Oct. 20, 2011

(51) Int. Cl.
*B66F 13/00* (2006.01)
*B66F 5/02* (2006.01)
*B66F 9/00* (2006.01)

(52) U.S. Cl.
USPC ..... 254/1; 254/2 B; 254/2 C; 254/8 B; 254/10 B; 254/10 C

(58) Field of Classification Search
USPC ..... 254/1, 10 R, 122, 93 R, 8 B, 10 C, 254/2 B, 2 C, 8 R, 9 C, 10 B, 9 B, 9 R, 93 H, 254/133 R, 134; D34/28, 31
See application file for complete search history.

(56) References Cited

U.S. PATENT DOCUMENTS

| | | | | | |
|---|---|---|---|---|---|
| 2,361,544 | A | * | 10/1944 | Hastings, Jr. | 280/46 |
| 4,984,657 | A | * | 1/1991 | Burns | 187/207 |
| 5,271,603 | A | * | 12/1993 | White | 254/10 C |
| D344,835 | S | * | 3/1994 | MacEachern | D34/31 |
| D346,255 | S | * | 4/1994 | Francis et al. | D34/31 |
| D378,155 | S | * | 2/1997 | Bartow et al. | D34/28 |
| 6,050,546 | A | * | 4/2000 | Peschmann et al. | 254/10 B |
| 6,241,227 | B1 | * | 6/2001 | Berdan et al. | 269/17 |
| 6,561,487 | B2 | * | 5/2003 | Siglock | 254/134 |
| 6,769,668 | B2 | * | 8/2004 | Siglock | 254/124 |
| 6,966,542 | B2 | * | 11/2005 | Bettencourt | 254/131 |
| 6,986,503 | B2 | | 1/2006 | Arzouman | |
| 7,137,615 | B2 | | 11/2006 | Ray, Jr. et al. | |
| 2004/0096306 | A1 | * | 5/2004 | Carlsson | 414/685 |
| 2010/0207085 | A1 | * | 8/2010 | Thurm | 254/2 C |

OTHER PUBLICATIONS

Statement Regarding Prior Art by Justin Poplin dated Jul. 21, 2010.
Office Action dated Nov. 23, 2012 issued in related U.S. Appl. No. 13/250,580, 10 pages.

* cited by examiner

*Primary Examiner* — Lee D Wilson
*Assistant Examiner* — Seahee Yoon
(74) *Attorney, Agent, or Firm* — Lathrop & Gage LLP

(57) ABSTRACT

One disclosed lifting apparatus includes a base, a receiving portion, and a first pair of laterally offset arms. The base has proximal and distal ends, and the laterally offset arms are rotatably coupled to the base for movement between lowered and raised positions. The arms are also rotatably coupled to the receiving portion, and the receiving portion is relatively near the base distal end when the arms are at the lowered position. The arms of the first pair of arms do not share a common axis of rotation with one another. Further, a height of the first pair of arms when at the lowered position is less than the sum of: (a) a thickness of one arm of the first pair of arms; (b) a thickness of the other arm of the first pair of arms; and (c) a height of the base at the distal end.

19 Claims, 19 Drawing Sheets

LIFTING APPARATUS

BACKGROUND

The disclosed subject matter is directed to lifting apparatus, and in particular to apparatus capable of lifting low-clearance devices and selectively maintaining those devices at a lifted position.

SUMMARY

In one embodiment, a lifting apparatus includes a base, a receiving portion, and a first pair of laterally offset arms. The base has a proximal end and a distal end, and the laterally offset arms are rotatably coupled to the base for movement between lowered and raised positions. The arms are also rotatably coupled to the receiving portion, and the receiving portion is relatively near the base distal end when the arms are at the lowered position. The arms of the first pair of arms do not share a common axis of rotation with one another. Further, a height of the first pair of arms when at the lowered position is less than the sum of: (a) a thickness of one arm of the first pair of arms; (b) a thickness of the other arm of the first pair of arms; and (c) a height of the base at the distal end.

In another embodiment, a lifting apparatus includes a base, a first pair of rotatable arms, a second pair of rotatable arms, and a receiving portion. The base has a proximal end, a distal end, a first pair of generally parallel laterally offset channels with open top ends, and a second pair of generally parallel laterally offset channels with open top ends. The first pair of rotatable arms extends inside the first pair of channels. The second pair of rotatable arms extends inside the second pair of channels. One arm of the first pair of arms and one arm of the second pair of arms rotate about a generally common first axis, and the other arm of the first pair of arms and the other arm of the second pair of arms rotate about a generally common second axis. The first and second pairs of arms are rotatable in concert between lowered and raised positions. The arms of the first pair of arms are generally laterally adjacent one another when at the lowered position, and the arms of the second pair of arms are generally laterally adjacent one another when at the lowered position. One arm of the first pair of arms and one arm of the second pair of arms is rotatably coupled to the receiving portion about a generally common third axis, and the other arm of the first pair of arms and the other arm of the second pair of arms is rotatably coupled to the receiving portion about a generally common fourth axis. The first and second axes are separated by a distance generally equal to a distance between the third and fourth axes.

BRIEF DESCRIPTION OF THE DRAWINGS

FIG. 12 is a perspective view of a portion of the lifting apparatus of FIG. 1.

DETAILED DESCRIPTION

Figure 1:
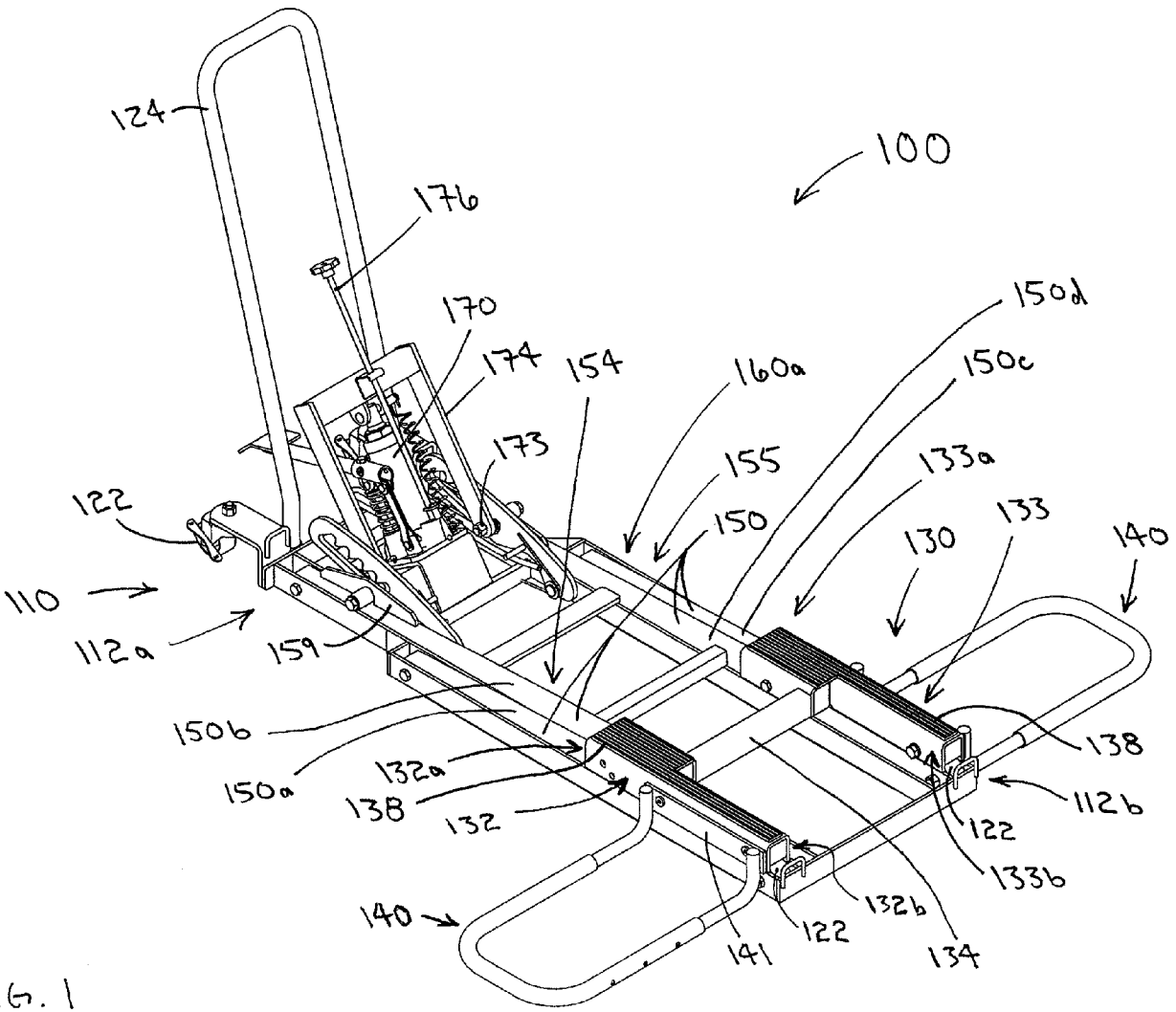
FIG. 1 is a perspective view of a lifting apparatus, at a lowered configuration.
Figure 2:
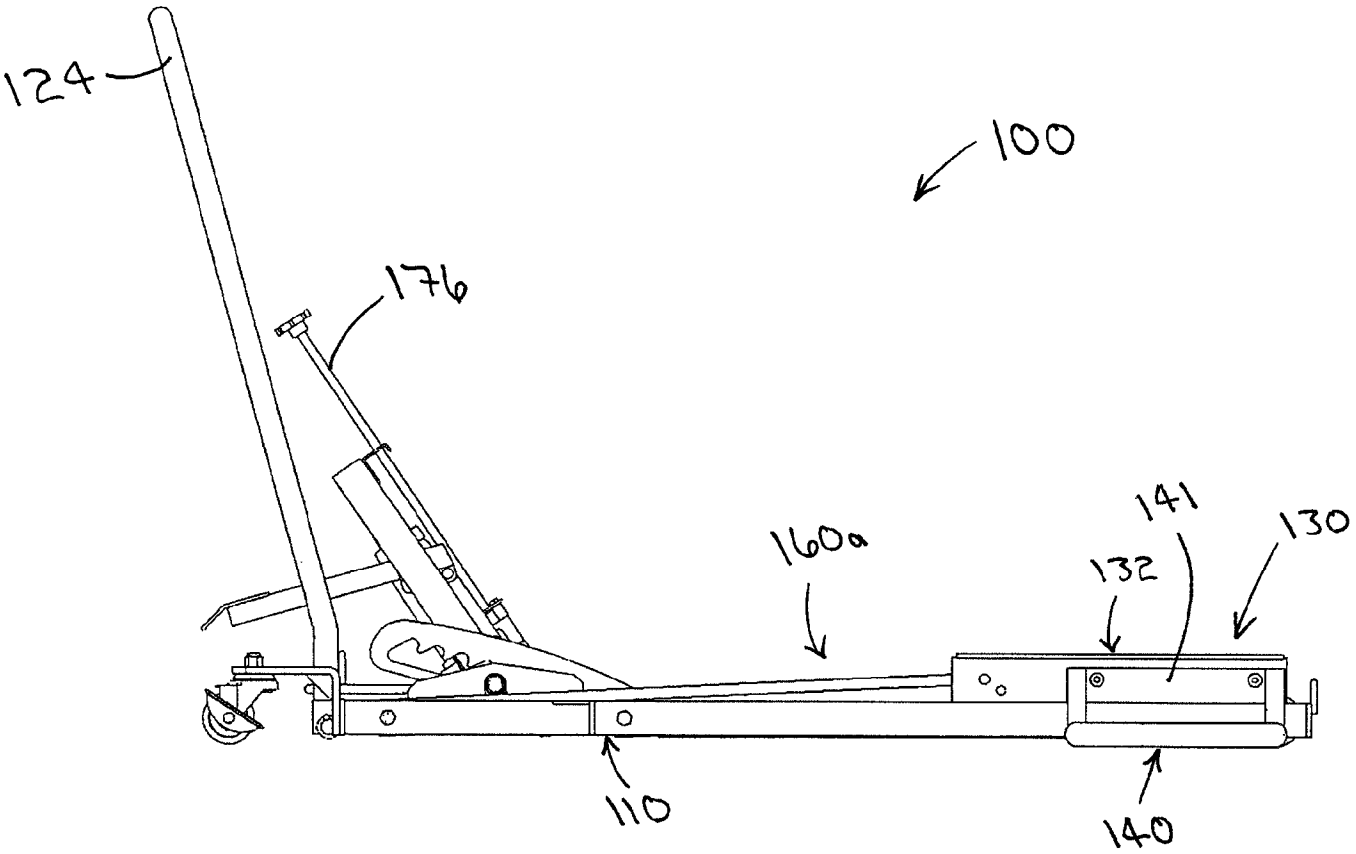
FIG. 2 is a side view of the lifting apparatus of FIG. 1, at the lowered configuration.
Figure 3:
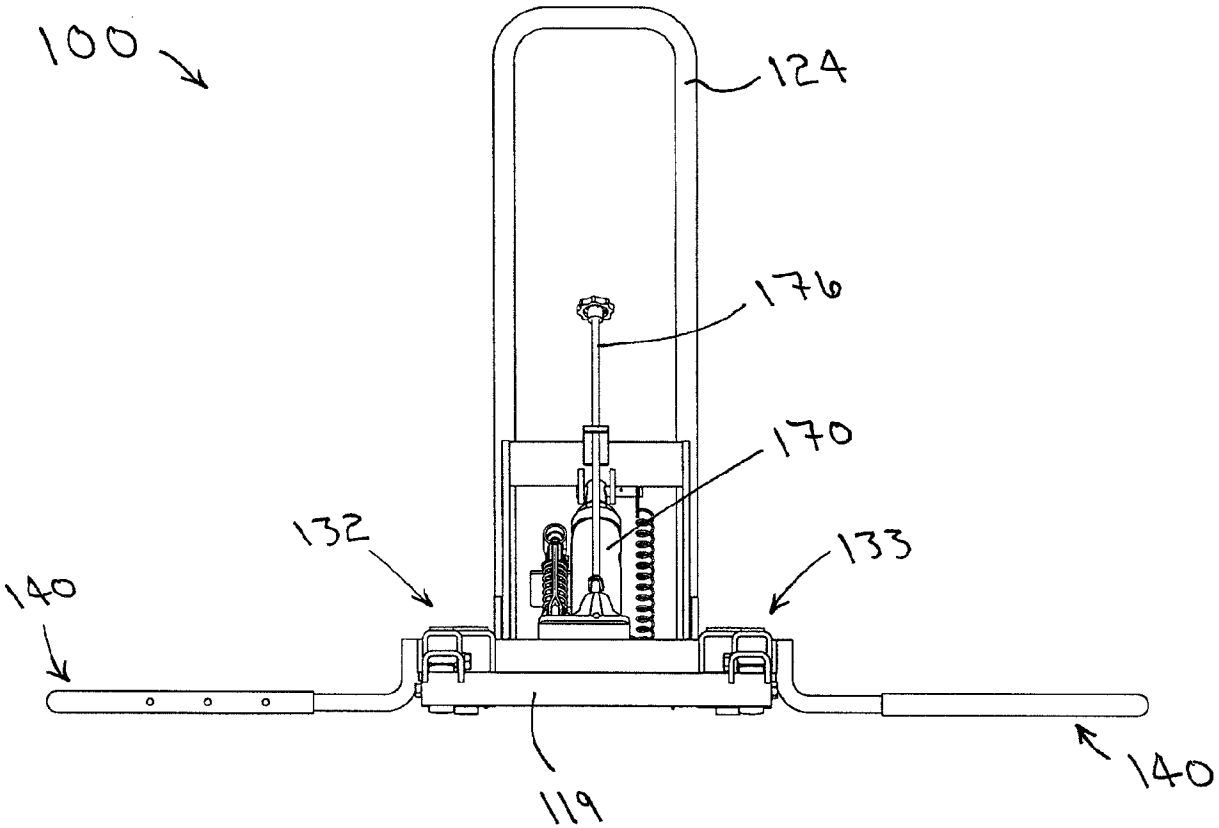
FIG. 3 is a front view of the lifting apparatus of FIG. 1, at the lowered configuration.

FIGS. 1 through 14 show a lifting apparatus 100 according to one embodiment. The lifting apparatus 100 has a base 110, a receiving portion 130, and a plurality of arms 150.

Figure 7:
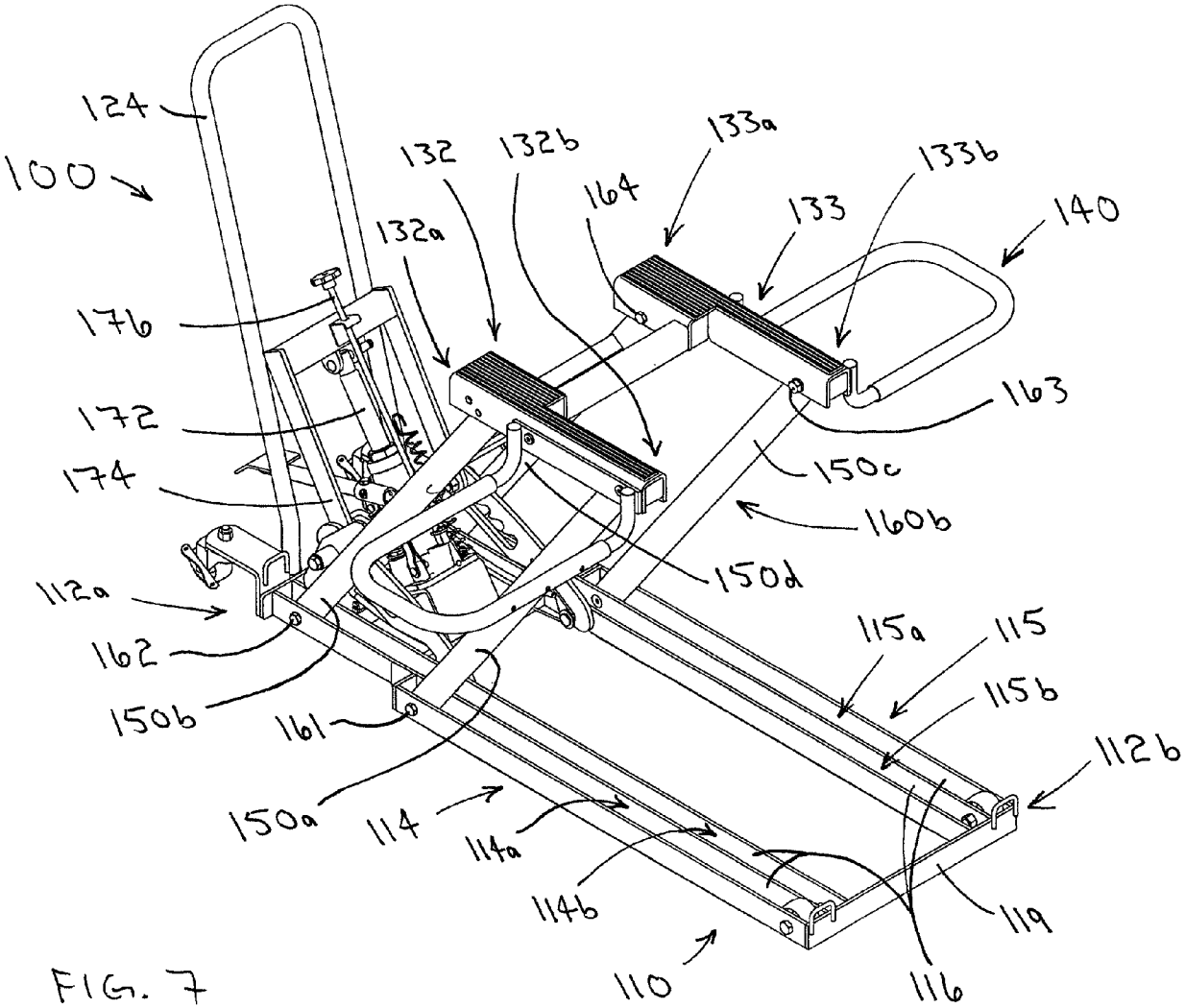
FIG. 7 is a perspective view of the lifting apparatus of FIG. 1, at a raised configuration.
Figure 8:
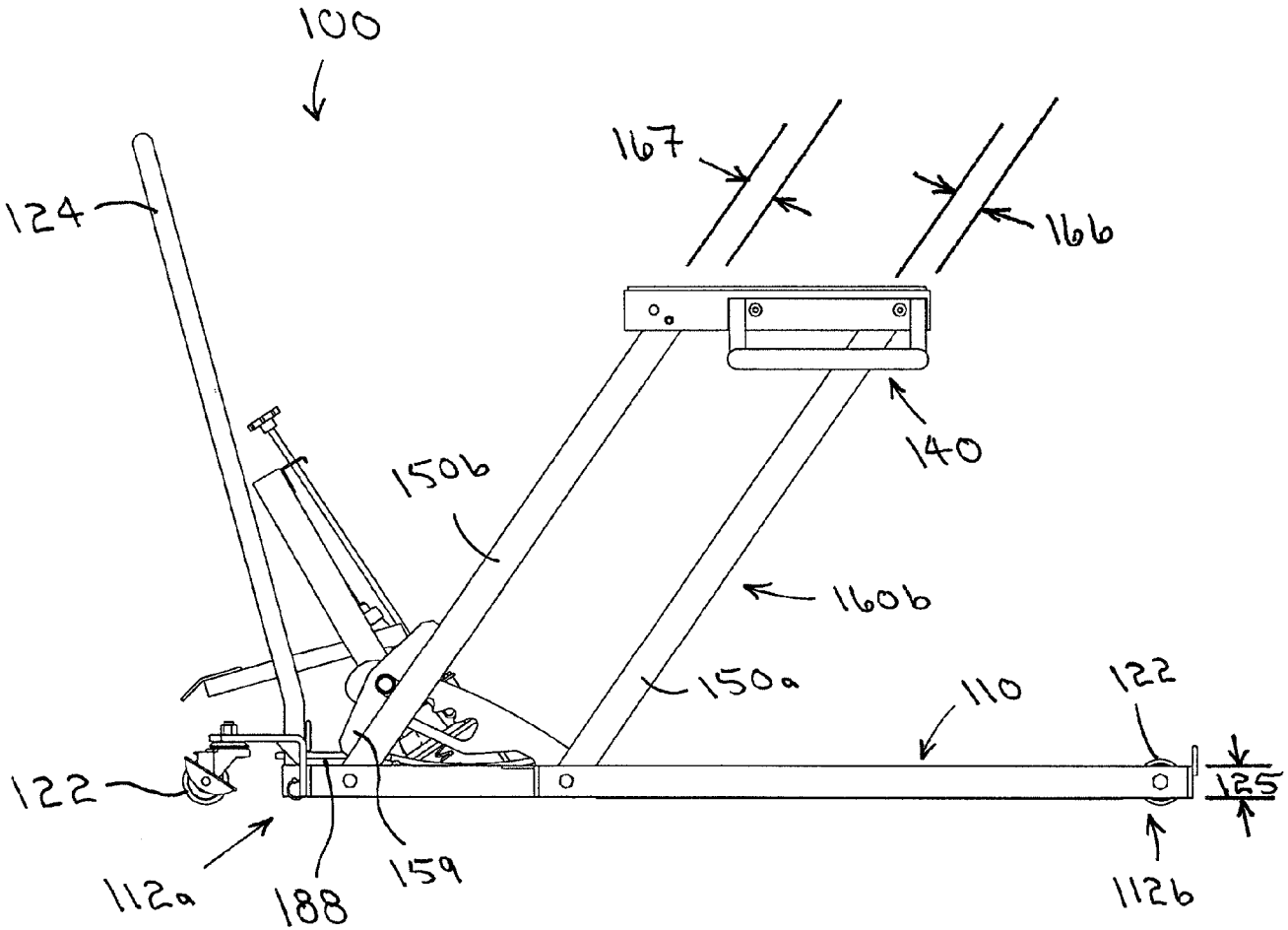
FIG. 8 is a side view of the lifting apparatus of FIG. 1, at the raised configuration.
Figure 9A:
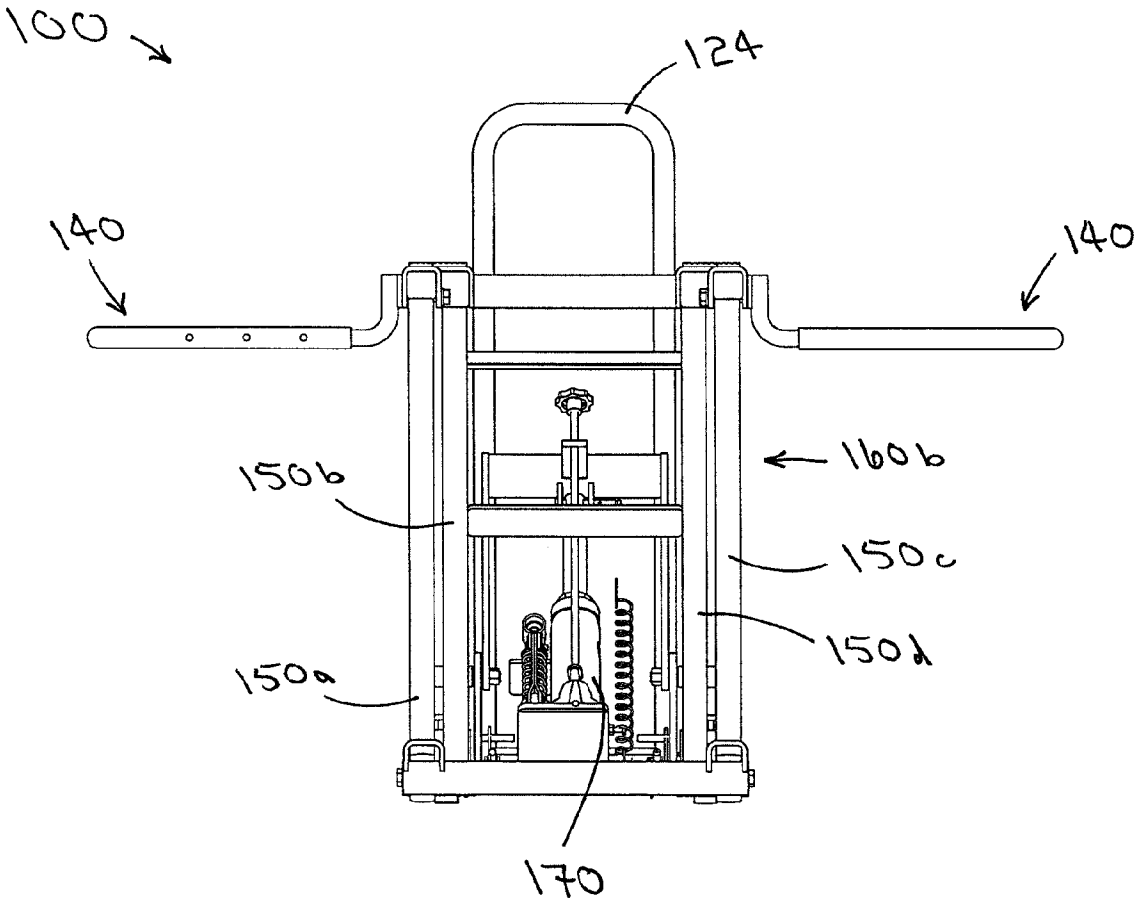
FIG. 9*a* is a front view of the lifting apparatus of FIG. 1, at the raised configuration.
Figure 9B:
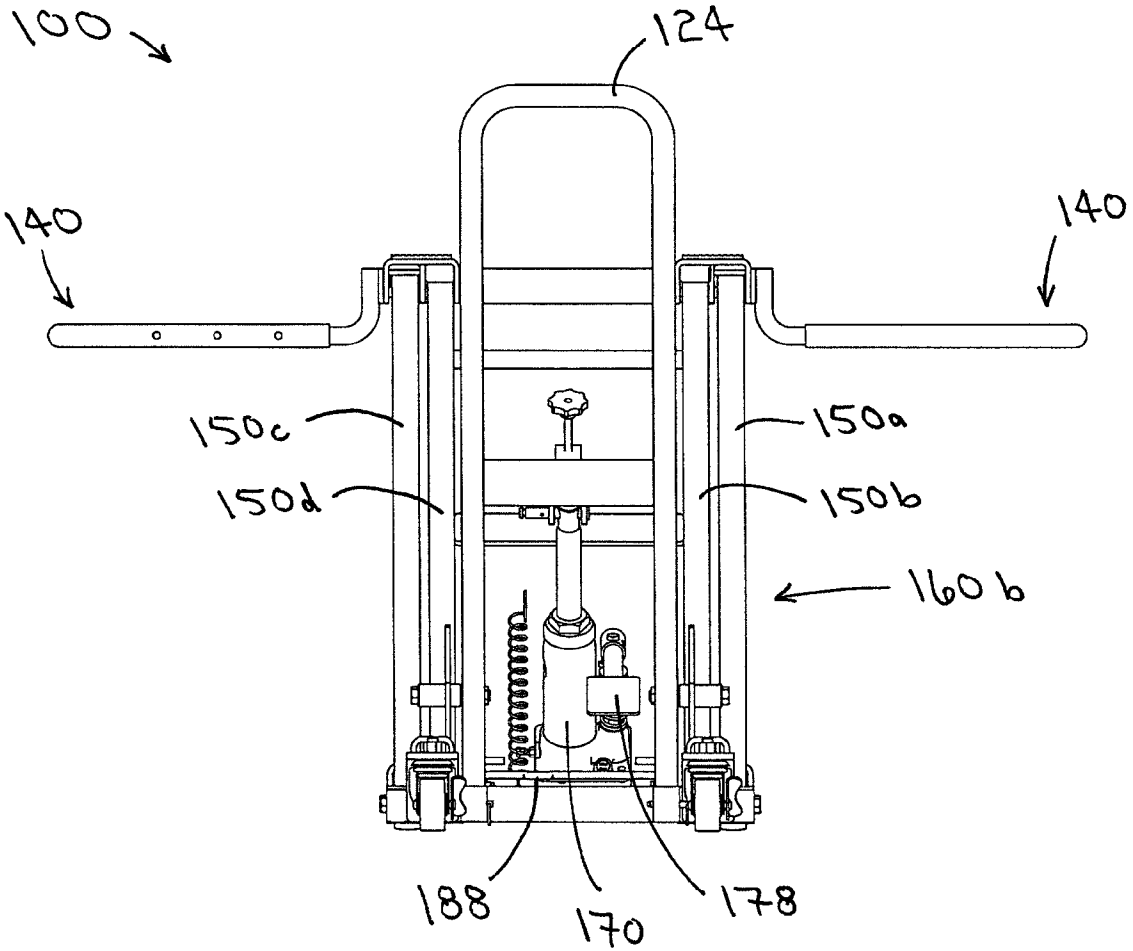
FIG. 9*b* is a rear view of the lifting apparatus of FIG. 1, at the raised configuration.
Figure 10:
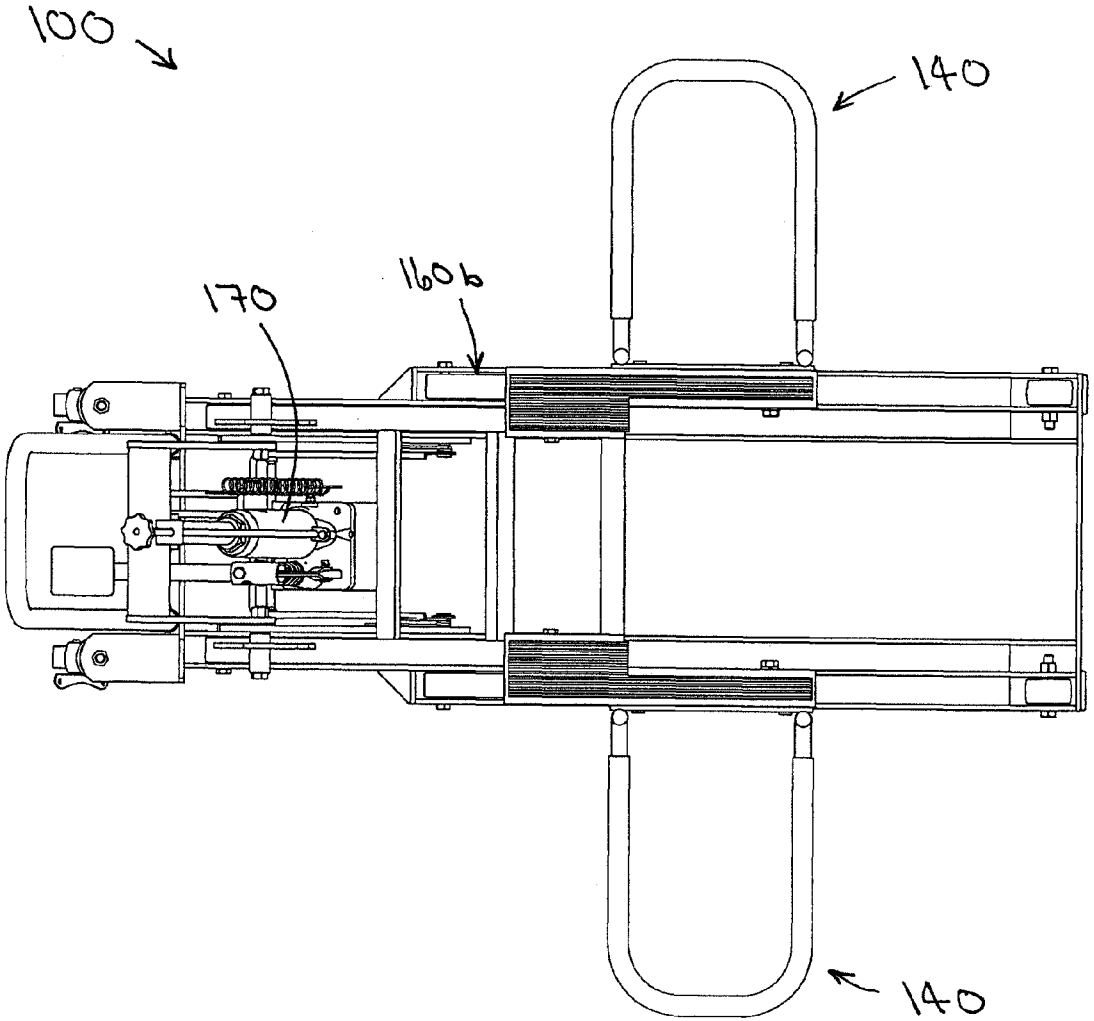
FIG. 10*a* is a top view of the lifting apparatus of FIG. 1, at the raised configuration.
FIG. 10*b* is a bottom view of the lifting apparatus of FIG. 1, at the raised configuration.
Figure 10B:
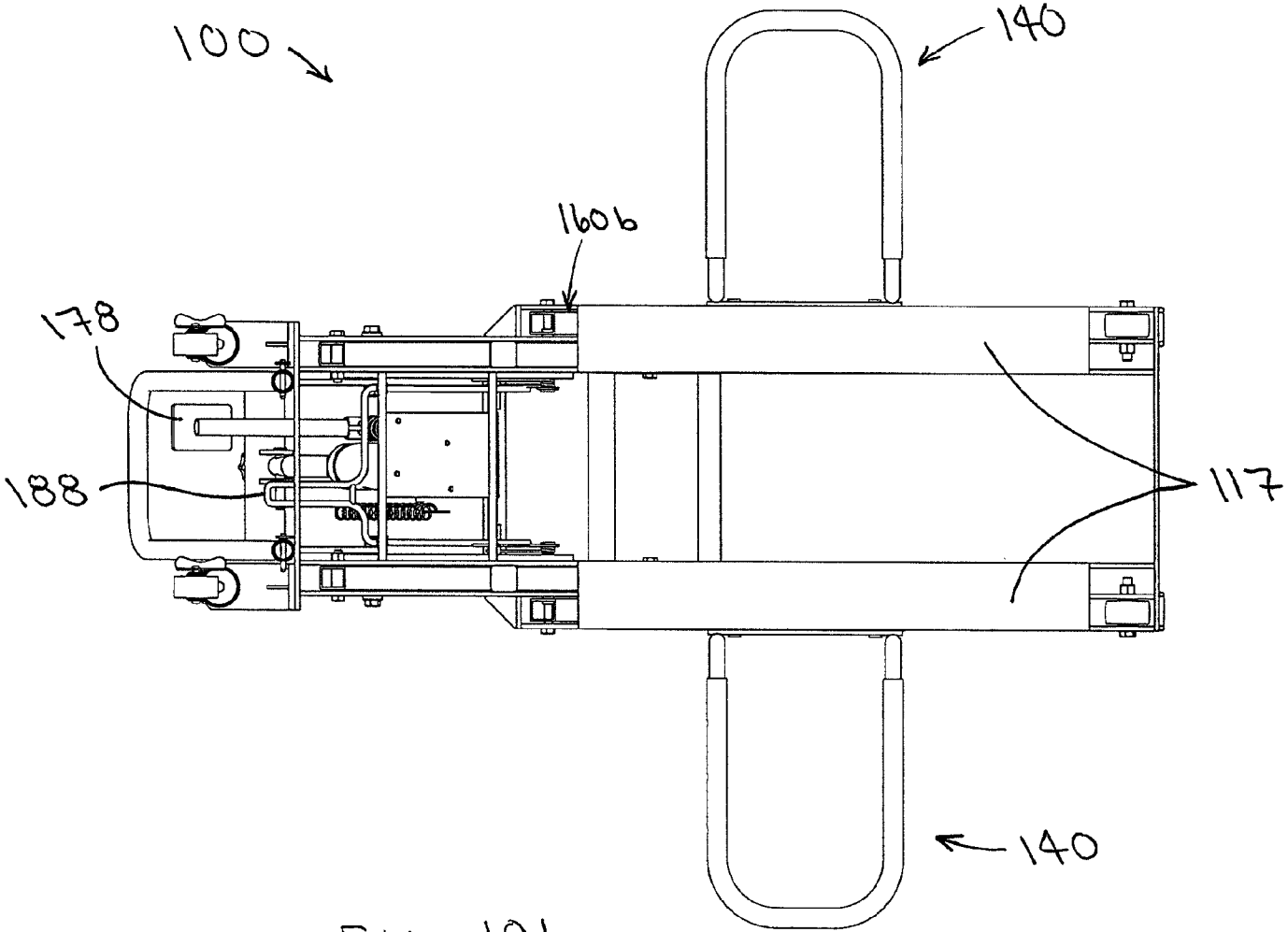

The base 110 is best shown in FIG. 7 and has proximal and distal ends 112*a*, 112*b*. As shown, the base 110 may have a first pair 114 of generally parallel laterally offset channels 114*a*, 114*b* and a second pair 115 of generally parallel laterally offset channels 115*a*, 115*b*. The channels 114*a*, 114*b*, 115*a*, 115*b* have open top ends 116 and may be sufficiently long and open to allow the arms 150 to be seated, as discussed further below. Strap 119 may fix the position of the first and second pairs of channels 114, 115 relative to one another at the distal end 112*b* and aid in transferring forces throughout the base 110, and the position of the first and second pairs of channels 114, 115 relative to one another at the proximal end 112*a* may also be fixed. Respective plates 117 (FIG. 6) may be located below the channels 114, 115 to prevent the base 110 from sinking in unstable (e.g., muddy) environments, and may also stabilize the base 110. The plates 117 may be, for example, 1.5 mm thick steel plate.

To aid in mobility, the base 110 may include wheels 122 and handle 124 (FIG. 1). But to prevent unintended movement, it may be desirable for at least two of the wheels 122 (e.g., the wheels 122 at the proximate end 112*a*) to be lockable. The base 110 may be constructed of steel, aluminum, and/or any other appropriate material, and may be formed through welding, riveting, and/or any other appropriate processes, as those skilled in the art will appreciate. The height 125 of the base 110 at the distal end 112*b* is specifically shown in FIG. 8, and is referenced further below.

Turning to the receiving portion 130, as shown for example in FIG. 1, it includes first and second platforms 132, 133 laterally spaced from one another. The first platform 132 has proximal and distal ends 132*a*, 132*b*, and the second platform 133 has proximal and distal ends 133*a*, 133*b*. A strap 134 may fix the position of the first and second platforms 132, 133 relative to one another, and the platforms 132, 133 may relate to the base 110 such that the platform distal ends 132*b*, 133*b* are closer to the base distal end 112*b* than the platform proximal ends 132*a*, 133*a* are to the base distal end 112*b*.

Figure 5A:
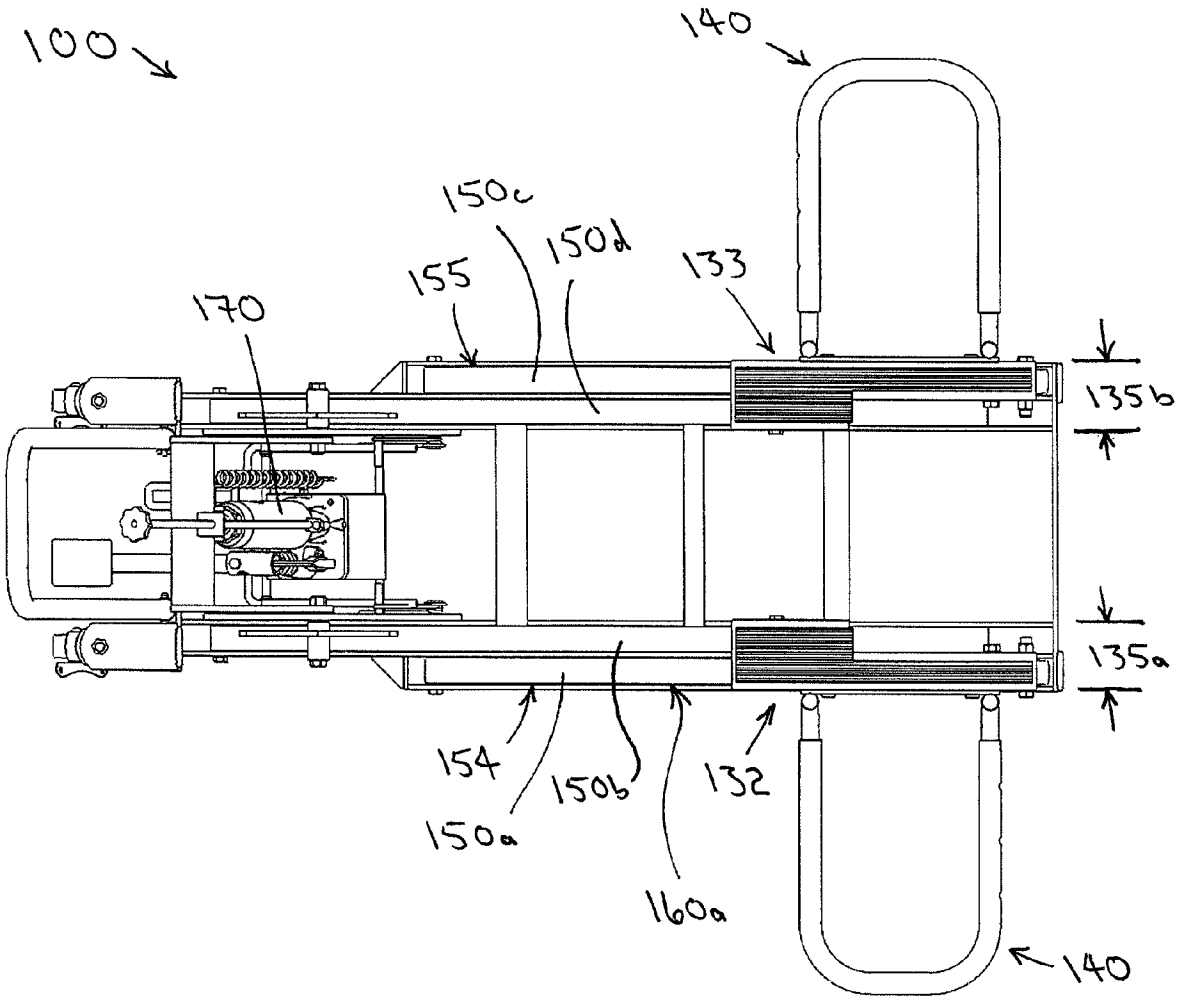
FIG. 5*a* is a top view of the lifting apparatus of FIG. 1, at the lowered configuration, and with tire-receiving members at a retracted configuration.

Though the platforms 132, 133 may be, for example, rectangular, it may be desirable for the platforms 132, 133 to instead be L-shaped (as shown) or otherwise configured such that a distance between the platform distal ends 132*b*, 133*b* is greater than a distance between the platform proximal ends 132*a*, 133*a*. In other words, it may be desirable for the opening between the platform distal ends 132*b*, 133*b* to be greater than the opening between the platform proximal ends 132*a*, 133*a*. As shown in FIG. 5*a*, the maximum width 135*a* of the platform 132 may generally correspond to the width of the first pair of arms 154 (discussed below), and the maximum width 135*b* of the platform 133 may generally correspond to the width of the second pair of arms 155 (discussed below).

As those skilled in the art will appreciate, the platforms 132, 133 may be constructed of steel, aluminum, and/or any other appropriate material, and may be formed through any appropriate processes. It may be desirable to have a non-slip material 138 at upper ends of the platforms 132, 133, as shown in FIG. 1

Figure 4:
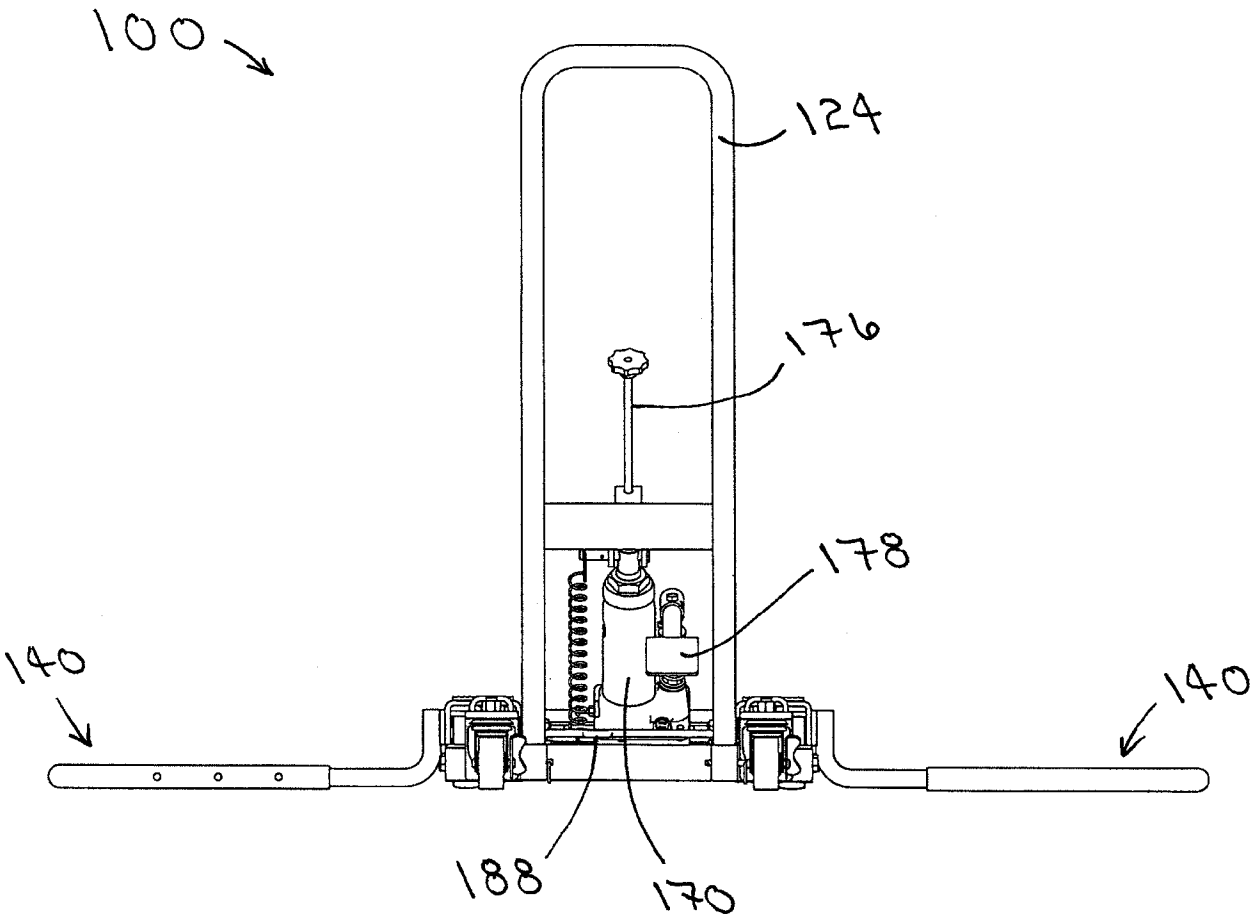
FIG. 4 is a rear view of the lifting apparatus of FIG. 1, at the lowered configuration.
Figure 5B:
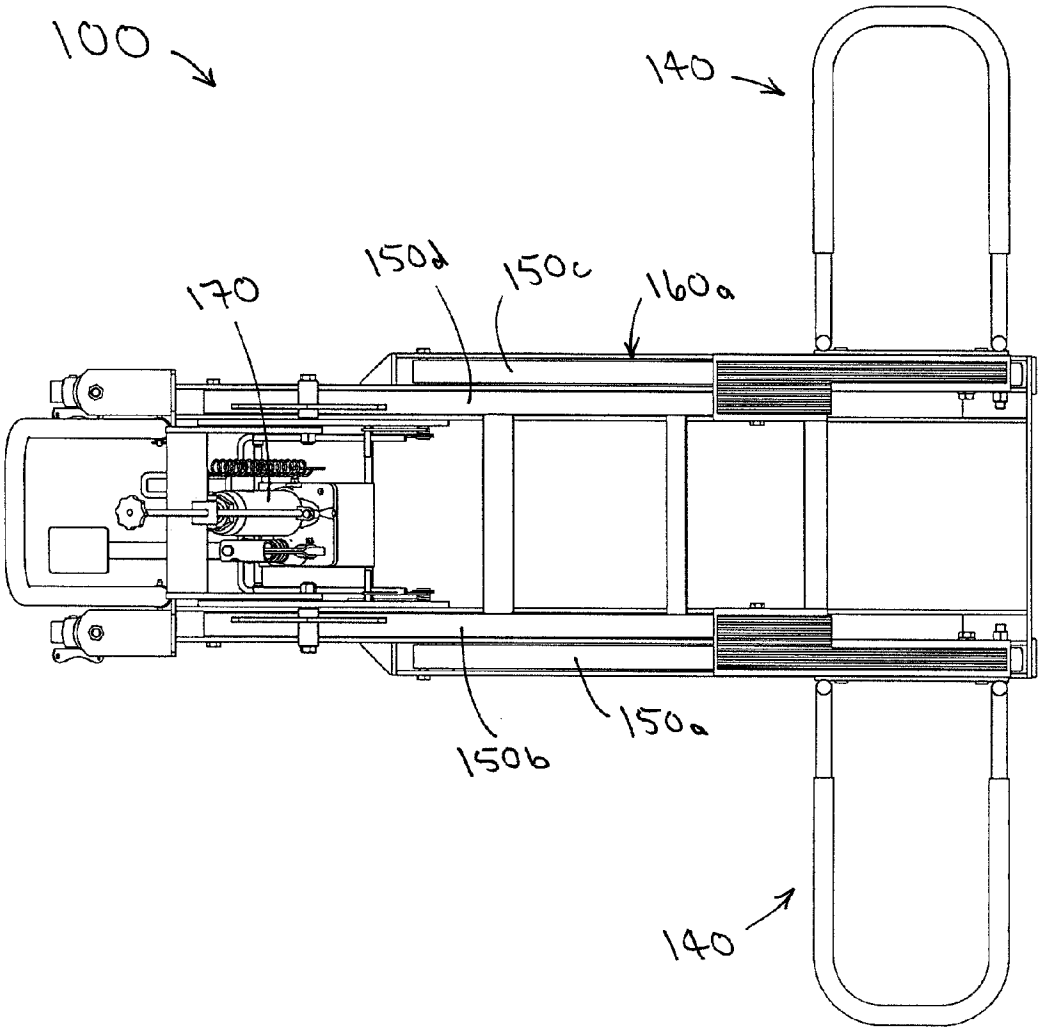
FIG. 5*b* is a top view of the lifting apparatus of FIG. 1, at the lowered configuration, and with tire-receiving members at a centrally-extended configuration.
Figure 5C:
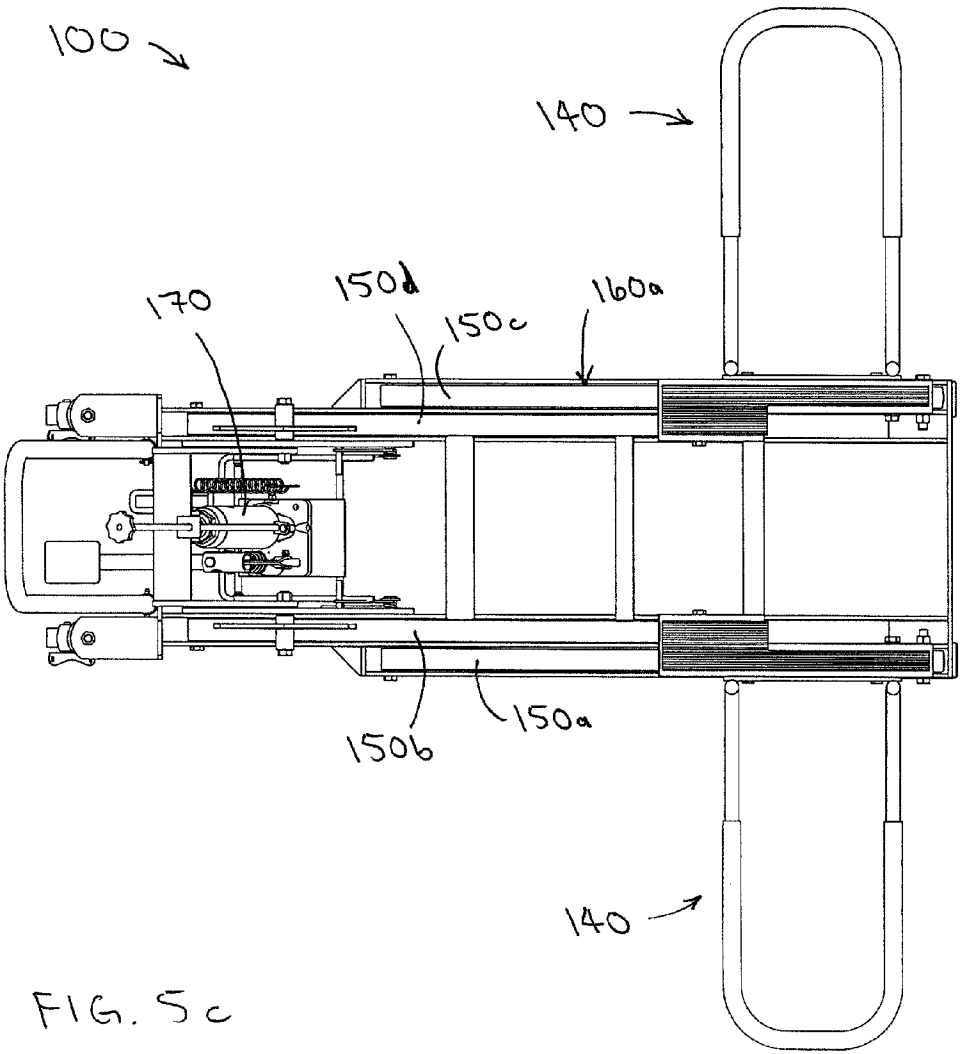
FIG. 5*c* is a top view of the lifting apparatus of FIG. 1, at the lowered configuration, and with tire-receiving members at an extended configuration.
Figure 6:
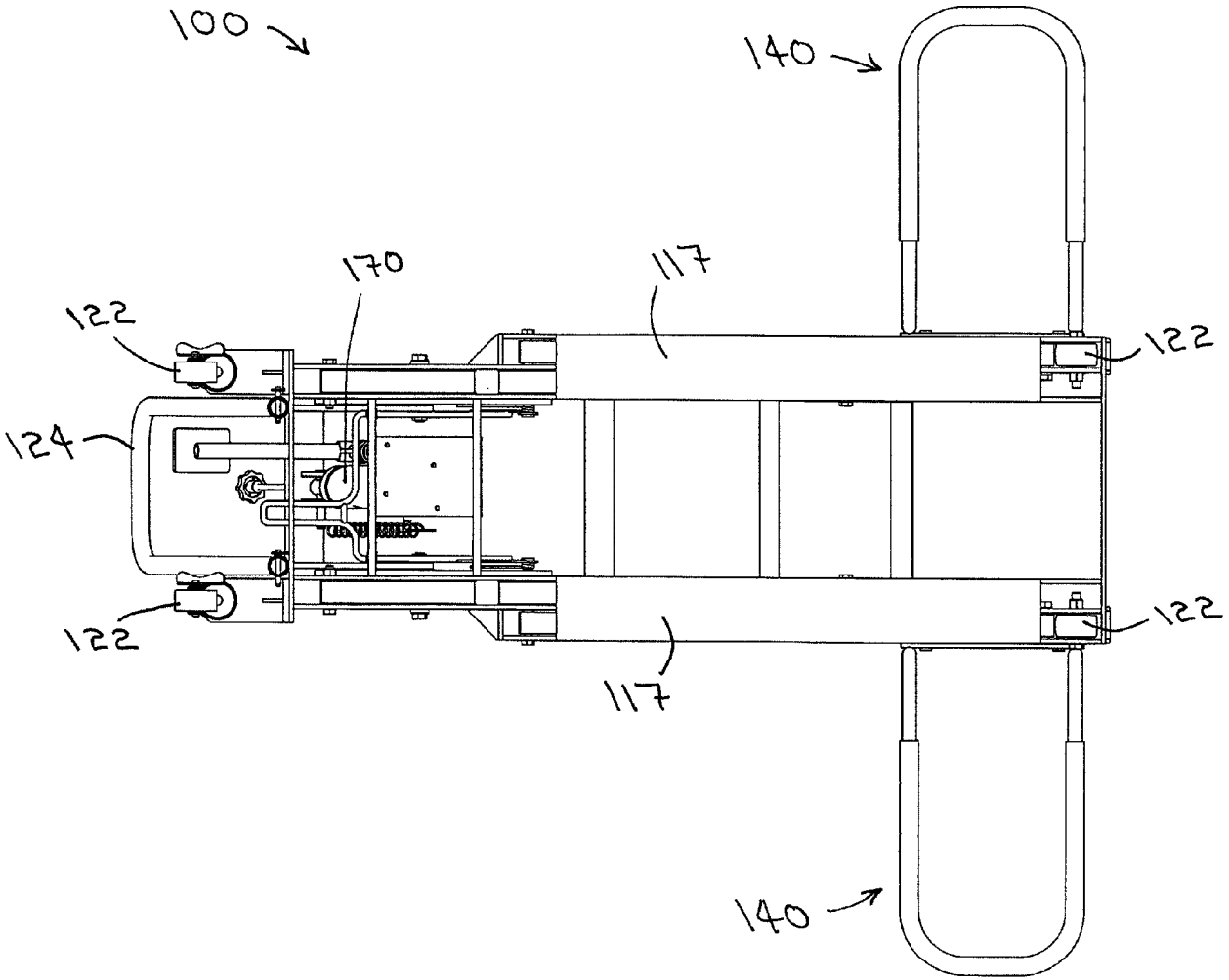
FIG. 6 is a bottom view of the lifting apparatus of FIG. 1, at the lowered configuration.
Figure 11:
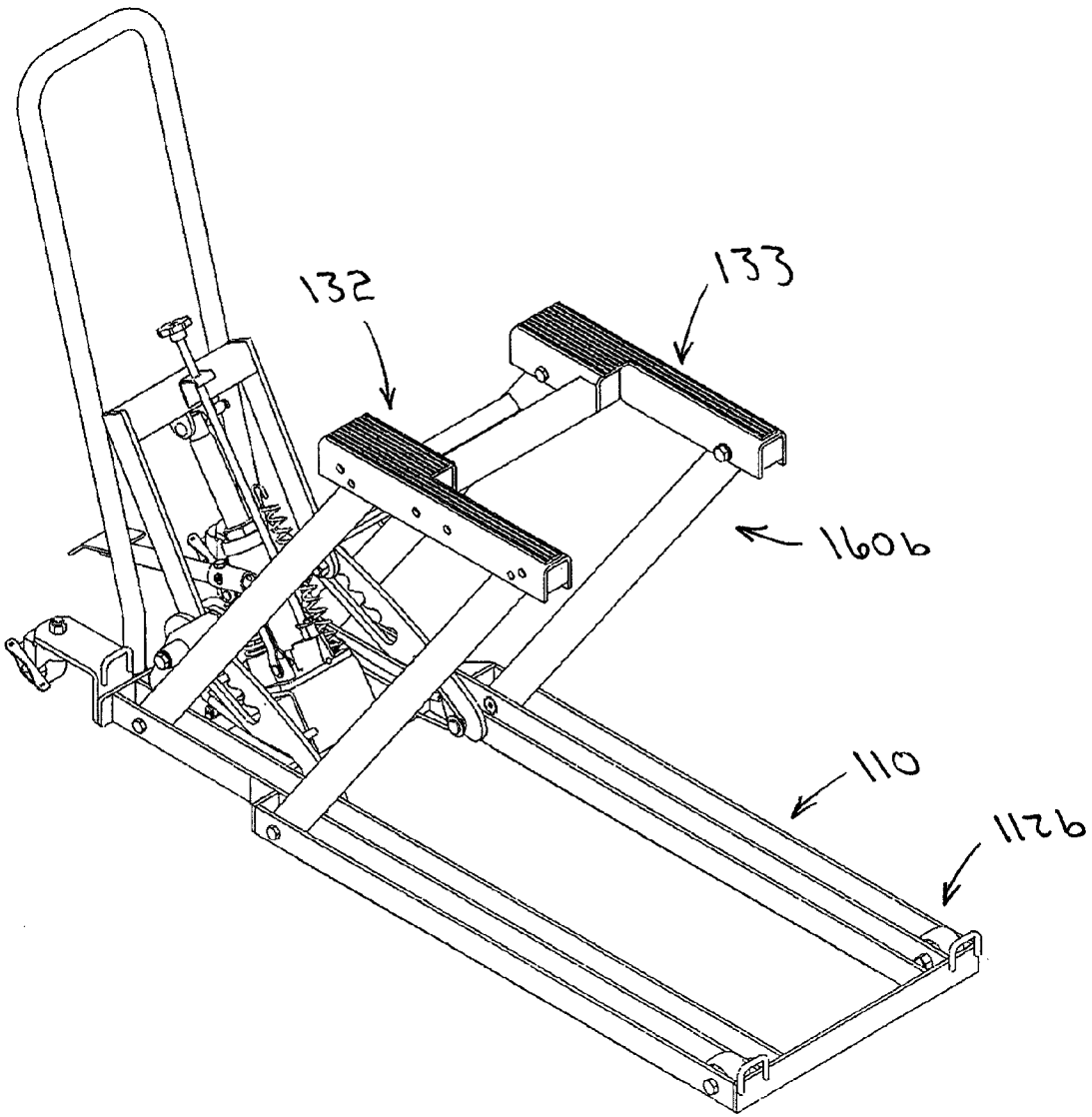
FIG. 11*a* is a perspective view of the lifting apparatus of FIG. 1, at the raised configuration, and with tire-receiving members removed.
FIG. 11*b* is a top view of the lifting apparatus of FIG. 1, at the lowered configuration, and with tire-receiving members removed.
Figure 11B:
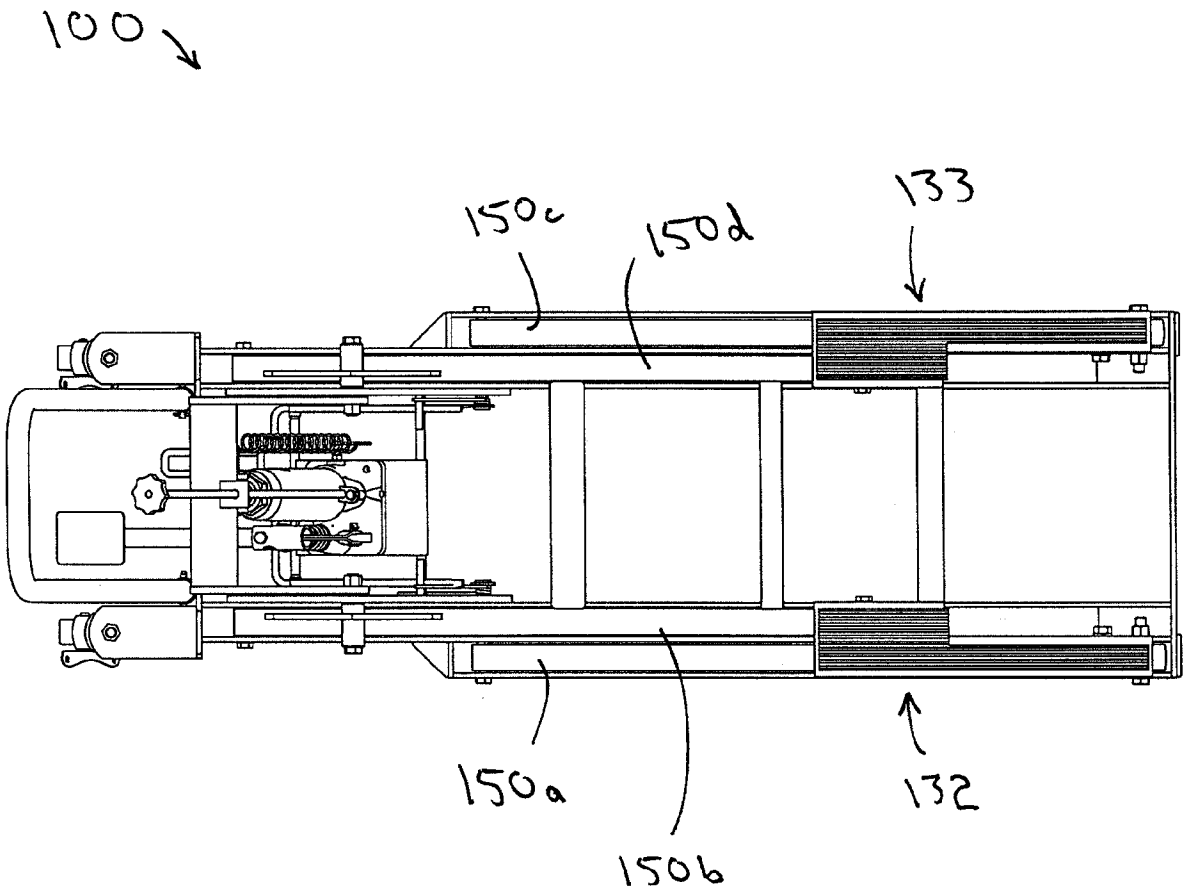
Figure 17:
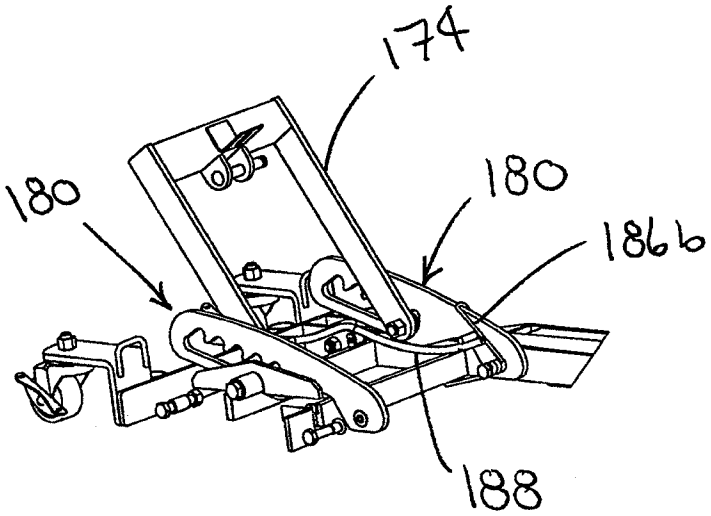

The receiving portion 130 may also include a tire-receiving member 140 operatively coupled to each platform 132, 133, and attachment between the tire-receiving members 140 and the platforms 132, 133 may be permanent or reversible (e.g., through quick-locking mechanisms, removable bolts, etc.). FIGS. 1 through 10*b* show the tire-receiving members 140 coupled to the platforms 132, 133, and FIGS. 11*a* and 11*b* show the platforms 132, 133 with the tire-receiving member 140 removed. Though not specifically shown in the drawings, plates 141 may have channels that allow the tire-receiving members 140 to be adjusted along the length of the platforms 132, 133, or the plates 141 may be received at different locations along the platforms 132, 133 to allow for adjustment. The tire-receiving members 140 extend outwardly from the respective platforms 132, 133, and (as shown for example in FIGS. 1 through 3) it may be preferable for the tire-receiving members 140 to extend outwardly below the respective platforms 132, 133. The tire-receiving members 140 may be U-shaped (as shown) or otherwise provide a configuration for securely receiving tires, and the tire-receiving members 140 may be telescopic to receive tires from devices having different spacings between the tires. For example, FIG. 5*a* shows the telescopic tire-receiving members 140 at a retracted configuration, FIG. 5*b* shows the telescopic tire-receiving members 140 at a centrally-extended configuration, and FIG. 5*c* shows the telescopic tire-receiving members 140 at an extended configuration. It may be desirable for at least a portion of the tire-receiving members 140 to be rubberized to increase friction between the tire-receiving members 140 and tires being situated thereon.

Attention now being directed to the arms 150, the arms 150 (specifically denoted in the drawings by reference numbers 150*a*, 150*b*) in the first pair 154 are laterally offset from one another and respectively extend inside the first pair 114 of channels 114*a*, 114*b*, and the arms 150 (specifically denoted in the drawings by reference numbers 150*c*, 150*d*) in the second pair 155 are laterally offset from one another and respectively extend inside the second pair 115 of channels 115*a*, 115*b*. All of the arms 150 are rotatably coupled to the base 110 for movement (i.e., rotation) in concert between a lowered position 160*a* (FIGS. 1 through 6 and 11*b*) and a raised position 160*b* (FIGS. 7 through 11*a*). While other configurations are clearly possible, it may be desirable for one arm 150 of each pair 154, 155 (e.g., arm 150*a* and arm 150*c*) to rotate relative to the base 110 about a generally common axis (e.g., an axis extending in line with pin 161, shown in FIG. 7), and for the other arm 150 of each pair 154, 155 (e.g., arm 150*b* and arm 150*d*) to rotate relative to the base 110 about another generally common axis (e.g., an axis extending in line with pin 162, shown in FIG. 7). An imaginary plane passing through these two imaginary axes may be generally horizontal, such that the axes are at approximately the same relative height. Further, the arms 150*a*, 150*b* in the first pair 154 do not share a generally common axis of rotation with one another, and the arms 150*c*, 150*d* in the second pair 155 do not share a generally common axis of rotation with one another. As shown in FIG. 1, the arms 150*a*, 150*b* in the first pair 154 are generally laterally adjacent one another when at the lowered position 160*a*, and the arms 150*c*, 150*d* in the second pair 155 are generally laterally adjacent one another when at the lowered position 160*a*.

All of the arms 150 are also rotatably coupled to the receiving portion 130, causing the receiving portion 130 to move between a lowered position when the arms 150 are at the lowered position 160*a* and a raised position when the arms 150 are at the raised position 160*b*. The receiving portion 130 is relatively near the base distal end 112*b* when the arms 150 are at the lowered position 160*a*, and it may be desirable for one arm 150 of each pair 154, 155 (e.g., arm 150*a* and arm 150*c*) to rotate relative to the receiving portion 130 about a generally common axis (e.g., an axis extending in line with pin 163 at the platform distal ends 132*b*, 133*b*, shown in FIG. 7), and for the other arm 150 of each pair 154, 155 (e.g., arm 150*b* and arm 150*d*) to rotate relative to the receiving portion 130 about another generally common axis (e.g., an axis extending in line with pin 164 at the platform proximal ends 132*a*, 133*a*, shown in FIG. 7). An imaginary plane passing through these two imaginary axes may remain generally horizontal, such that the receiving portion 130 stays relatively horizontal, regardless of whether the arms 150 are at the lowered or raised positions 160*a*, 160*b*. Those skilled in the art will realize that horizontal positioning is not required, so long as the arms 150, the base 110, and the receiving portion 130 form a parallelogram. To allow rotation of the arms 150, the distance between the pin 161 and the pin 162 (and thus the axes associated with those pins) may be generally equal to the distance between the pin 163 and the pin 164 (and thus the axes associated with those pins). As shown in FIG. 7, both arms 150*a*, 150*b* of the first pair of arms 154 may be coupled to the first platform 132, and both arms 150*c*, 150*d* of the second pair of arms 155 may be coupled to the second platform 133.

It may be very desirable for a height of the first pair 154 of arms 150*a*, 150*b* when at the lowered position 160*a* (FIGS. 1 through 6 and 11*b*) to be less than the sum of: a thickness 166 (FIG. 8) of the arm 150*a*, a thickness 167 (FIG. 8) of the arm 150*b*, and the height 125 (FIG. 8) of the base 110 at the distal end 112*b*. The second pair 155 of arms 150*c*, 150*d* may have similar dimensions to the first pair 154 such that the arms 150*c*, 150*d* (and thus also the receiving portion 130) are very low when at the lowered position 160*a*, allowing the lifting apparatus 100 to be used to raise low-clearance devices.

Figure 15:
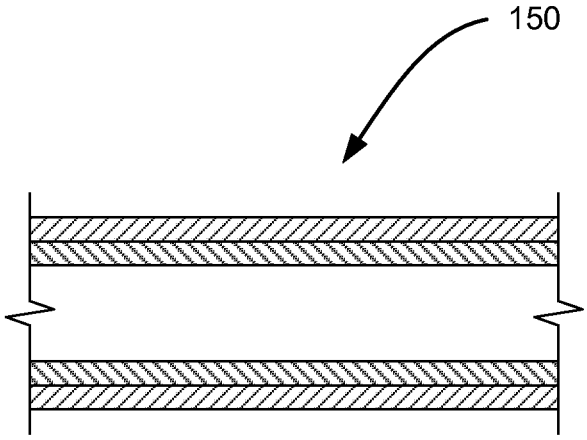
FIG. 15 is a sectional view showing a telescopic arm of the lifting apparatus according to one embodiment.

As those skilled in the art will appreciate, the arms 150 may be constructed of steel, aluminum, and/or any other appropriate material, and may be formed through any appropriate processes. And, as shown in FIG. 15, the arms 150 may be telescopic.

Various means for moving the pairs 154, 155 of arms 150 between the lowered and raised positions 160*a*, 160*b* may be included. For example, a winch may be used to wind and unwind a rope or chain coupled to one of the arms 150. Or, for example, a motor and gearing may be used to rotate one of the arms 150. Or, as shown throughout the drawings, a pump 170 (e.g., a hydraulic or pneumatic pump) may be in communication with at least one of the arms 150 to selectively move the arms 150 between the lowered and raised positions 160*a*, 160*b*. In the embodiment shown in the drawings, the pump 170 moves a piston 172 (FIG. 7), which is operatively coupled to two of the arms 150 (and particularly to a flange 159 on each arm 150*b*, 150*d*) by pins 173 and structure 174. The pump 170 includes a controlled release valve 176 (FIG. 1), allowing the arms 150 to move from the raised position 160*b* to the lowered position 160*a* at various controlled speeds. As shown in FIG. 4, a foot pedal 178 may be used to actuate the pump 170, though other inputs are of course possible.

Figure 13:
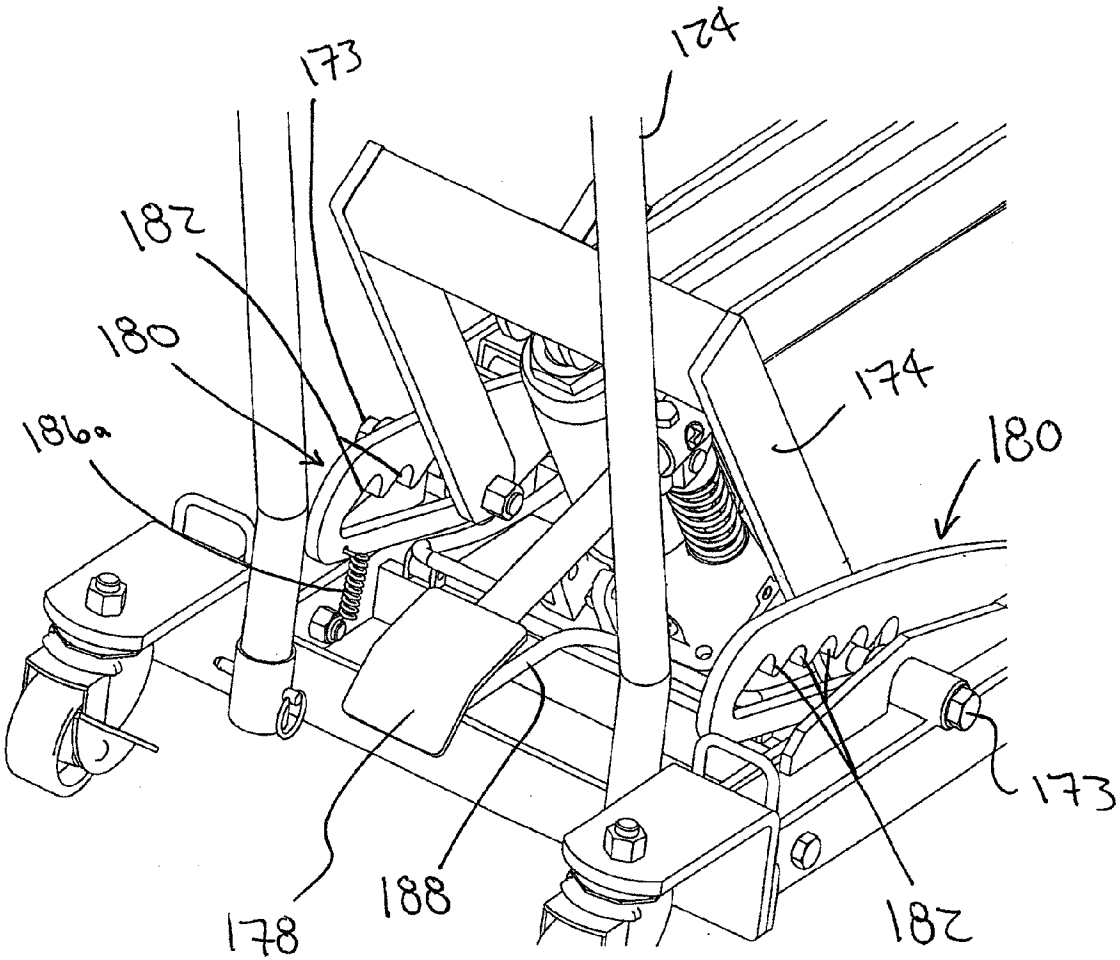
FIG. 13 is another perspective view of a portion of the lifting apparatus of FIG. 1.
Figure 14:
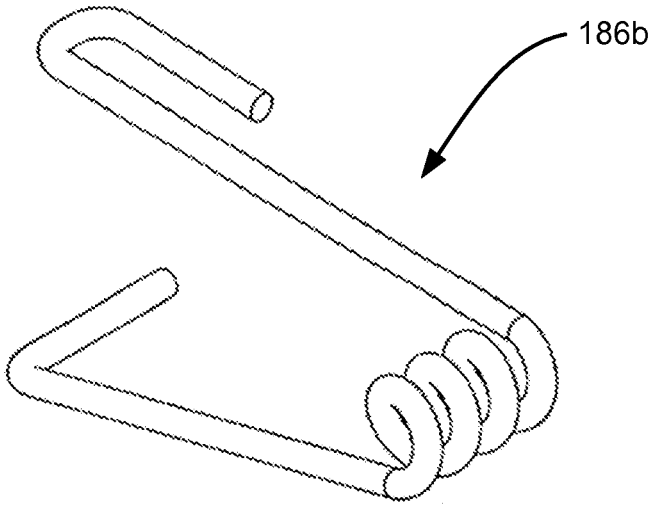
FIG. 14 is another perspective view of a portion of the lifting apparatus of FIG. 1.

Various means may also be included for mechanically maintaining the arms 150 at the raised position 160*b* to prevent the arms 150 from undesirably moving from the raised position 160*b* to the lowered position 160*a*. For example, as shown in FIGS. 12 and 13, a rack 180 may be engageable with at least one of the arms 150 (e.g., through interaction between slots 182 and the pins 173 coupled to respective arms 150) to restrict the arms 150 from leaving the raised position 160*b*. The rack 180 may be automatically biased toward engaging the arm 150 by a resilient member, such as by spring 186*a* (FIG. 13) and/or spring 186*b* (FIGS. 12 and 14). A release 188 (FIGS. 4, 12, 13) is in communication with the rack 180 for selectively disengaging the rack 180 to allow the first and second pairs 154, 155 of arms 150 to move from the raised position 160*b* to the lowered position 160*a*, and may be operable by foot (as shown).

In use, a device (or "load") to be lifted is placed atop the receiving portion 130. For example, tires of a lawn tractor may be received by the tire-receiving members 140. Due to the proximity of the tire-receiving members 140 to the ground (made possible, for example, by the arms 150 being laterally offset and the tire-receiving members 140 extending below the platforms 132, 133 as discussed above), the tires may be easily received in the tire-receiving members 140. If necessary, the tire-receiving members 140 may be telescopically extended to correspond to the spacing between the tires. The configuration and spacing of the platforms 132, 133 may avoid interference with a mower deck of the lawn tractor, and it should be appreciated that other low-clearance devices may accordingly be received as well.

It should also be understood that the receiving portion 130 may be utilized with the tire-receiving members 140 removed, ° as discussed above and shown in FIGS. 11*a* and 11*b*. More particularly, in applications where lifting by wheels is desirable (e.g., when lifting a lawn tractor), the tire-receiving members 140 may be used as described above, and in applications where lifting in a more traditional manner is desirable (e.g., when lifting a small All Terrain Vehicle (ATV), three-wheeler, or motor scooter), the tire-receiving members 140 may be disconnected and set aside, and the load may be supported by the platforms 132, 133.

To raise the load, the pump 170 may be actuated (such as through the foot pedal 178), causing the piston 172 to extend (FIG. 7). Extension of the piston 172 causes the pins 173 to raise, which in turn causes the arms 150*b*, 150*d* connected to the pins 173 to raise. Raising the arms 150*b*, 150*d* further causes the receiving portion 130 and the remaining arms 150*a*, 150*c* to raise, as those elements are all rotatably coupled together. As the arms 150 raise, the pins 173 automatically interact with subsequent rack slots 182 (e.g., due to the spring 186*a*, the spring 186*b*, and/or the weight of the rack 180) to restrict the arms 150 from lowering, even if the pump 170 fails. Due to the level of safety provided by the arms 150 being mechanically maintained at the raised position 160*b*, people may work underneath the lifted load without fear of the load being unintentionally lowered.

To lower the load, the release 188 (FIGS. 4, 12, 13) is moved (e.g., by foot) to disengage the rack 180 and allow the first and second pairs 154, 155 of arms 150 to move from the raised position 160*b* to the lowered position 160*a*. While the rack 180 is disengaged, the controlled release valve 176 may be used to release pressure, lowering the piston 172 and thus also lowering the arms 150 and the receiving portion 130. The controlled release valve 176 may allow the load to be lowered at various speeds to suit various applications. Once the arms 150 are at the lowered position 160*a*, the load may be easily removed from the receiving portion 130.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations are of utility and may be employed without reference to other features and subcombinations and are contemplated within the scope of the claims. Moreover, various steps set forth herein may be carried out in orders that differ from those set forth herein without departing from the scope of the present methods. The description should not be restricted to the above embodiments, but should be measured by the following claims.

The invention claimed is:

1. A lifting apparatus, comprising:

a base having a proximal end, a distal end, a first pair of generally parallel laterally offset channels with open top ends, and a second pair of generally parallel laterally offset channels with open top ends;

a first pair of rotatable arms extending inside the first pair of channels;

a second pair of rotatable arms extending inside the second pair of channels; one arm of the first pair of arms and one arm of the second pair of arms rotating about a generally common first axis; the other arm of the first pair of arms and the other arm of the second pair of arms rotating about a generally common second axis; the first and second pairs of arms being rotatable in concert between lowered and raised positions; the arms of the first pair of arms being generally laterally adjacent one another when at the lowered position; the arms of the second pair of arms being generally laterally adjacent one another when at the lowered position;

a receiving portion; the one arm of the first pair of arms and the one arm of the second pair of arms being rotatably coupled to the receiving portion about a generally common third axis; the other arm of the first pair of arms and the other arm of the second pair of arms being rotatably coupled to the receiving portion about a generally common fourth axis; the first and second axes being separated by a distance generally equal to a distance between the third and fourth axes.

2. The lifting apparatus of claim 1, wherein:
an imaginary plane passing through the first and second axes remains generally horizontal; and
an imaginary plane passing through the third and fourth axes remains generally horizontal.

3. The lifting apparatus of claim 1, wherein:
the arms of the first pair of arms are telescopic; and
the arms of the second pair of arms are telescopic.

4. The lifting apparatus of claim 1, wherein the receiving portion includes first and second platforms laterally spaced from one another and each having proximal and distal ends, the platform distal ends being closer to the base distal end than the platform proximal ends are to the base distal end, a distance between the platform distal ends being greater than a distance between the platform proximal ends, one of the third axis and the fourth axis being at the platform proximal ends, the other of the third axis and the fourth axis being at the platform distal end.

5. The lifting apparatus of claim 4, wherein the receiving portion includes a first tire-receiving member extending outwardly from the first platform and a second tire-receiving member extending outwardly from the second platform.

6. The lifting apparatus of claim 5, wherein the first and second tire-receiving members extend outwardly below the first and second platforms.

7. The lifting apparatus of claim 6, wherein:
the first and second tire-receiving members are each telescopic;
the first tire-receiving member is removably coupled to the first platform; and
the second tire-receiving member is removably coupled to the second platform.

8. The lifting apparatus of claim 7, further comprising:
means for moving the first and second pairs of arms between the lowered and raised positions; and
means for mechanically maintaining the first and second pairs of arms at the raised position to prevent the first and second pairs of arms from undesirably moving from the raised position to the lowered position.

9. The lifting apparatus of claim 7, further comprising a pump in communication with at least one of the arms to selectively move the first and second pairs of arms to the raised position.

10. The lifting apparatus of claim 9, wherein the pump includes a controlled release valve allowing the first and second pairs of arms to move to the lowered position at various speeds.

11. The lifting apparatus of claim 1, further comprising:
a rack engageable with at least one of the arms to selectively maintain the first and second pairs of arms at the raised position to prevent the first and second pairs of arms from undesirably moving from the raised position to the lowered position;
a resilient member biasing the rack toward engaging at least one of the arms; and
a release in communication with the rack for selectively disengaging the rack to allow the first and second pairs of arms to move from the raised position to the lowered position.

12. A low-clearance lifting apparatus, comprising:
a base having a proximal end and a distal end;
a receiving portion; and
a first pair of laterally offset arms rotatably coupled to the base for movement between lowered and raised positions, the first pair of arms being rotatably coupled to the receiving portion, the receiving portion being relatively near the base distal end when the first pair of arms is at the lowered position, the arms of the first pair of arms not sharing a common axis of rotation with one another;
wherein a height of the first pair of arms when at the lowered position is less than the sum of:
(a) a thickness of one arm of the first pair of arms;
(b) a thickness of the other arm of the first pair of arms; and
(c) a height of the base at the distal end.

13. The lifting apparatus of claim 12, further comprising:
a rack engageable with at least one of the arms to selectively maintain the first pair of arms at the raised position to prevent the first pair of arms from undesirably moving from the raised position to the lowered position; and
a resilient member biasing the rack toward engaging at least one of the arms; and
a release in communication with the rack for selectively disengaging the rack to allow the first pair of arms to move from the raised position to the lowered position.

14. The lifting apparatus of claim 13, further comprising a pump in communication with at least one of the arms to selectively move the first pair of arms to the raised position, the pump including a controlled release valve allowing the first pair of arms to move to the lowered position at various speeds.

15. The lifting apparatus of claim 14, further comprising a second pair of laterally offset arms rotatably coupled to the base for movement between lowered and raised positions, the second pair of arms being rotatably coupled to the receiving portion, the receiving portion being relatively near the base distal end when the second pair of arms is at the lowered position; wherein:
the receiving portion includes first and second platforms laterally spaced from one another and each having proximal and distal ends;
the platform distal ends are closer to the base distal end than the platform proximal ends are to the base distal end; and
a distance between the platform distal ends is greater than a distance between the platform proximal ends.

16. The lifting apparatus of claim 15, wherein the receiving portion includes a first tire-receiving member operatively coupled to the first platform and a second tire-receiving member operatively coupled to the second platform, the first and second tire-receiving members extending outwardly below the first and second platforms.

17. The lifting apparatus of claim 12, further comprising a second pair of laterally offset arms rotatably coupled to the base for movement between lowered and raised positions, the second pair of arms being rotatably coupled to the receiving portion, the receiving portion being relatively near the base distal end when the second pair of arms is at the lowered position; wherein a height of the second pair of arms when at the lowered position is less than the sum of:
(a) a thickness of one arm of the second pair of arms;
(b) a thickness of the other arm of the second pair of arms; and
(c) the height of the base at the distal end.

18. The lifting apparatus of claim 17, wherein the receiving portion includes a first tire-receiving member operatively coupled to the first platform and a second tire-receiving member operatively coupled to the second platform, the first and second tire-receiving members extending outwardly below the first and second platforms.

19. The lifting apparatus of claim 12, wherein:
the receiving portion includes first and second platforms laterally spaced from one another; and
each arm of the first pair of arms is coupled to the first platform.

* * * * *